US010309121B2

(12) United States Patent
Choi

(10) Patent No.: US 10,309,121 B2
(45) Date of Patent: Jun. 4, 2019

(54) EAVE STRUCTURE AND TENT FRAME HAVING SAME

(71) Applicant: Campvalley (Xiamen) Co. Ltd., Xiamen (CN)

(72) Inventor: Kwan Jun Choi, Xiamen (CN)

(73) Assignee: Campvalley (Xiamen) Co., LTD., Xiamen (CN)

( * ) Notice: Subject to any disclaimer, the term of this patent is extended or adjusted under 35 U.S.C. 154(b) by 0 days.

(21) Appl. No.: 15/709,222

(22) Filed: Sep. 19, 2017

(65) Prior Publication Data

US 2018/0080242 A1 Mar. 22, 2018

(30) Foreign Application Priority Data

Sep. 19, 2016 (CN) ..... 2016 2 1061691

(51) Int. Cl.

*E04H 15/46* (2006.01)
*E04H 15/58* (2006.01)
*E04H 15/50* (2006.01)

(52) U.S. Cl.

CPC ..... *E04H 15/46* (2013.01); *E04H 15/50* (2013.01); *E04H 15/58* (2013.01)

(58) Field of Classification Search

CPC ..... E04H 15/48; E04H 15/50; E04H 15/44; E04H 15/46; E04H 15/405; E04H 15/32; E04H 15/58

USPC ..... 135/130–131, 135, 139, 143–147, 117

See application file for complete search history.

(56) References Cited

U.S. PATENT DOCUMENTS

| | | | |
|---|---|---|---|
| 1,061,547 | A | 5/1913 | Kennedy |
| 1,347,107 | A | 7/1920 | McCann |
| 3,888,056 | A | 6/1975 | Kelly |
| 4,286,612 | A | 9/1981 | Neal |
| 4,630,627 | A | 12/1986 | Windows |
| 4,641,676 | A | 2/1987 | Lynch |
| 4,793,371 | A | 12/1988 | O'Ferrell |
| 4,944,321 | A | 7/1990 | Moyet-Ortiz |
| 5,224,507 | A | 7/1993 | Vosse |
| 5,275,188 | A | 1/1994 | Tsai |
| 5,421,356 | A | 6/1995 | Lynch |
| 5,794,640 | A | 8/1998 | Jang |
| 5,813,425 | A | 9/1998 | Carter |
| 5,944,040 | A | 8/1999 | Jang |
| 6,182,917 | B1 | 2/2001 | Lai |

(Continued)

FOREIGN PATENT DOCUMENTS

| | | | |
|---|---|---|---|
| CA | 2895981 | A1 | 12/2015 |
| CN | 2401649 | Y | 10/2000 |

(Continued)

*Primary Examiner* — Winnie Yip

(74) *Attorney, Agent, or Firm* — Morgan, Lewis & Bockius LLP

(57) ABSTRACT

Disclosed are eave structures and tent frames with integrated eave structures. A tent frame includes supporting poles, an upper frame coupled with the supporting poles, and two or more eave structures. An eave structure includes an eave pole, and a sleeve member disposed at a connector coupled with a supporting pole. The eave pole has a first end portion pivotally connected with an oblique pole of the upper frame, and a second end portion slidably coupled with the sleeve member. The eave structures can be folded and unfolded together with the supporting poles and the upper frame. When unfolded, the eave poles of the eave structures extend beyond the upper frame.

15 Claims, 10 Drawing Sheets

(56) References Cited

U.S. PATENT DOCUMENTS

| | | | |
|---|---|---|---|
| 6,206,020 | B1 | 3/2001 | Lynch |
| 6,463,948 | B2 | 10/2002 | Lee |
| 6,598,614 | B2 | 7/2003 | Liu |
| 6,708,707 | B2 | 3/2004 | Dotterweich |
| 6,718,995 | B2 | 4/2004 | Dotterweich |
| 6,848,461 | B2 | 2/2005 | Tsai |
| 6,929,017 | B2 | 8/2005 | Byun |
| 7,055,538 | B2 | 6/2006 | Deng |
| 7,240,686 | B2 | 7/2007 | Seo |
| 7,296,584 | B2 | 11/2007 | Goldwitz |
| 7,299,813 | B2 | 11/2007 | Ochi |
| 7,316,239 | B2 | 1/2008 | Yang |
| 7,360,549 | B2 | 4/2008 | Seo |
| 7,395,830 | B2 | 7/2008 | Seo |
| 7,422,026 | B2 | 9/2008 | Kim |
| 8,220,477 | B2 | 7/2012 | Park |
| 8,544,489 | B2 | 10/2013 | Choi |
| 8,616,226 | B2 | 12/2013 | Ma |
| 8,701,692 | B2 | 4/2014 | Holland |
| D705,884 | S | 5/2014 | Jin |
| 8,776,816 | B2 | 7/2014 | Danziger |
| 8,893,737 | B2 | 11/2014 | Yang |
| 8,910,648 | B2 | 12/2014 | Jin |
| 9,243,422 | B2 | 1/2016 | Hunt |
| 9,528,292 | B1 | 12/2016 | Lovely, II |
| 9,580,929 | B2 | 2/2017 | Ma |
| 9,739,073 | B2 | 8/2017 | Huang |
| 9,869,110 | B2 | 1/2018 | Krenzel |
| 9,926,720 | B2 | 3/2018 | Huang |
| 2001/0050098 | A1 | 12/2001 | Lee |
| 2002/0074032 | A1 | 6/2002 | Park |
| 2004/0144412 | A1 | 7/2004 | Tsai |
| 2005/0241688 | A1 | 11/2005 | Wu |
| 2006/0169312 | A1 | 8/2006 | Choi |
| 2007/0012347 | A1 | 1/2007 | Ochi |
| 2007/0051397 | A1 | 3/2007 | Choi |
| 2007/0144572 | A1 | 6/2007 | Patel |
| 2007/0221262 | A1 | 9/2007 | Tsai |
| 2009/0032079 | A1 | 2/2009 | Choi |
| 2010/0043856 | A1 | 2/2010 | Park |
| 2011/0073148 | A1 | 3/2011 | Choi |
| 2012/0291830 | A1 | 11/2012 | Crimi |
| 2013/0014794 | A1 | 1/2013 | Jin |
| 2013/0247948 | A1 | 9/2013 | Lovely et al. |
| 2013/0284225 | A1 | 10/2013 | Holland |
| 2014/0174491 | A1 | 6/2014 | Yang |
| 2014/0261601 | A1 | 9/2014 | Jin |
| 2014/0261602 | A1 | 9/2014 | Ampoyo |
| 2014/0290710 | A1 | 10/2014 | Choi |
| 2015/0083177 | A1 | 3/2015 | Hotes |
| 2015/0247339 | A1 | 9/2015 | Lee |
| 2015/0308147 | A1 | 10/2015 | Lee |
| 2015/0376913 | A1 | 12/2015 | Choi |
| 2016/0108639 | A1 | 4/2016 | Huang |
| 2016/0348392 | A1 | 12/2016 | Jin |
| 2017/0121999 | A1 | 5/2017 | Ma |
| 2017/0292287 | A1 | 10/2017 | Lovely, II |
| 2018/0080242 | A1 | 3/2018 | Choi |
| 2018/0080243 | A1 | 3/2018 | Choi |
| 2018/0106066 | A1 | 4/2018 | Choi |
| 2018/0106067 | A1 | 4/2018 | Choi |
| 2018/0106068 | A1 | 4/2018 | Choi |
| 2018/0142493 | A1 | 5/2018 | Choi |

FOREIGN PATENT DOCUMENTS

| | | | |
|---|---|---|---|
| CN | 201202302 | Y | 3/2009 |
| CN | 103590650 | B | 2/2014 |
| CN | 104265063 | A | 1/2015 |
| CN | 104358468 | A | 2/2015 |
| CN | 204163467 | U | 2/2015 |
| FR | 1 121 851 | | 8/1956 |
| FR | 68588 | | 5/1958 |
| JP | 4557885 | B2 | 10/2010 |
| WO | WO 2010/104939 | A1 | 9/2010 |
| WO | WO 2011/022764 | A1 | 3/2011 |
| WO | WO 2013/116545 | A1 | 8/2013 |

EAVE STRUCTURE AND TENT FRAME HAVING SAME

CROSS-REFERENCE TO RELATED APPLICATIONS

The present application claims priority of Chinese Utility Model Applications CN 201621061691.7 filed on Sep. 19, 2016, the entire contents of which application are incorporated herein for all purposes by this reference.

FIELD OF THE INVENTION

The present invention generally relates to tent frames. More particularly, the present invention relates to eave structures and foldable tent frames having such eave structures.

BACKGROUND

There are a variety of tents. Usually, small-to-medium-sized tents are used for camping and large pavilion type foldable tents are used as outdoor sunshades.

An existing pavilion type tent includes supporting poles, an upper frame supported by the supporting poles and a tent cloth coving the upper frame. The shading area a tent can provide is directly proportional to the area formed by outer sides of the tent cloth. One way to increase the shading area is to enlarge the upper frame, for instance, by increasing the lengths of the poles constituting the upper frame. A drawback of having longer poles is that the folded tent may not be compact. In addition, to support a larger upper frame, additional supporting poles and/or other auxiliary elements are needed to ensure the stability of the tent. As a result, the weight of the tent is increased.

Another way to provide a larger shading area is to design a tent or tent frame with eave supporting frames. For instance, FIGS. 1 and 2 illustrates an existing tent including eave supporting frame 4' provided on an outer side of each supporting pole 1'. Eave supporting frame 4' includes eave main pole 41' and eave auxiliary pole 42'. One end of eave main pole 41' is pivotally connected to fixed seat 23' at the top end of the supporting pole 1' and the other end is connected with an outer side of the tent cloth. One end of eave auxiliary pole 42' is pivotally connected to sliding block 43' slidably coupled with supporting pole 1'. The other end of eave auxiliary pole 42' is pivotally connected to eave main pole 41'. Eave supporting frame 4' and upper frame 2' can be folded and unfolded together. It should be noted that sliding block 43' is necessary to ensure the proper folding and unfolding of the tent frame.

However, the configuration of eave supporting frame 4' with two poles (main and auxiliary poles) and additional sliding block increases the total number of poles and other elements needed for making a tent frame. It also makes the structure of the tent frame relatively complex. It further increases the size of the tent frame when folded.

In another existing tent frame, eave poles are slidably coupled to the fixed seats or the upper poles of the main frames. The eave poles cannot be folded or unfolded along with the main frame. Instead, the eave poles have to be manually and separately operated. For instance, the eave poles have to be manually pulled out after the main frame is unfolded, and have to be manually pushed in (or taken out) before folding the main frame. As such, the tent/tent frame is inconvenient to use.

Given the current state of the art, there remains a need for tent frames and eave structures that address the abovementioned issues.

The information disclosed in this Background section is provided for an understanding of the general background of the invention and is not an acknowledgement or suggestion that this information forms part of the prior art already known to a person skilled in the art.

SUMMARY

Various embodiments of the present invention provide eave structures and tent frames that are convenient to use, can help to provide larger shading areas when unfolded, and are compact when folded.

In some embodiments, the present invention provides an eave structure of a tent frame, where the tent frame includes a supporting pole, an upper pole and an oblique pole. The eave structure includes a sleeve member and an eave pole. The sleeve member is configured to be disposed at a first connector of the tent frame. The eave pole has a first end portion configured to be pivotally connected with the oblique pole, and a second end portion configured to be slidably coupled with the sleeve member. The first connector is fixedly coupled with an upper end portion of the supporting pole. The upper pole includes a first pole and a second pole, each having a first end portion and a second end portion. The first end portion of the first pole is pivotally connected with a hub of the tent frame, the second end portion of the first pole is pivotally connected with the first end portion of the second pole, and the second end portion of the second pole is pivotally connected with the first connector. The oblique pole has a first end portion pivotally connected with the second pole of the upper pole at a position between the first and second end portions of the second pole of the upper pole, and a second end portion pivotally connected with a second connector of the tent frame. The second connector is slidably coupled with the supporting pole and movable along the supporting pole below the first connector. When the tent frame is unfolded, the second end portion of the eave pole passes through the sleeve member and extends outwardly beyond the upper pole.

In some embodiments, the eave structure further includes a link member to pivotally connect the first end portion of the eave pole with the oblique pole at a position between the first and second end portions of the oblique pole. In an embodiment, the link member is of a "Z" or "S" shape, with a first end portion to pivotally connect with the first end portion of the eave pole and a second end portion to pivotally connect with the oblique pole at the position between the first and second end portions of the oblique pole.

In some embodiments, one or more of the sleeve member and the link member are configured such that when the tent frame is unfolded, the eave pole is sloped substantially the same as the second pole of the upper pole. In an embodiment, the sleeve member is formed with a through hole through which the second end portion of the eave pole passes. When in an unfolded state in which the eave pole is sloped substantially the same as the second pole of the upper pole, an interior upper surface of the through hole serves as a stopper to restrain the eave pole from further rotating beyond the unfolded state.

In an embodiment, the sleeve member is fixedly coupled with or integrally formed with the first connector at a top of the first connector. In an embodiment, a pivoting member is disposed at the first connector apart from a side of the sleeve member, and fixedly coupled with or integrally formed with the first connector. In such an embodiment, the second end portion of the second pole of the upper pole is disposed between the pivoting member and the sleeve member, and pivotally connected with one or more of the pivoting member and the sleeve member.

In an alternative embodiment, a pivoting member is fixedly coupled or integrally formed with the first connector. The pivoting member includes a groove to accommodate the second end portion of the second pole of the upper pole. The sleeve member is rotatably coupled with a side of the pivoting member.

In some embodiments, the present invention provides an eave structure of a tent frame which includes a supporting pole, an upper pole and an oblique pole. The eave structure includes a first connector, a sleeve member and an eave pole. The first connector is configured to be fixedly coupled with an upper end portion of the supporting pole, and the sleeve member is disposed at the first connector. The eave pole has a first end portion configured to be pivotally connected with the oblique pole, and a second end portion configured to be slidably coupled with the sleeve member. The upper pole includes a first pole and a second pole, each having a first end portion and a second end portion. The first end portion of the first pole is pivotally connected with a hub of the tent frame, the second end portion of the first pole is pivotally connected with the first end portion of the second pole, and the second end portion of the second pole is pivotally connected with the first connector. The oblique pole has a first end portion pivotally connected with the second pole of the upper pole at a position between the first and second end portions of the second pole of the upper pole, and a second end portion pivotally connected with a second connector of the tent frame. The second connector is slidably coupled with the supporting pole and movable along the supporting pole below the first connector. When the tent frame is unfolded, the second end portion of the eave pole passes through the sleeve member and extends outwardly beyond the upper pole.

In some embodiments, the eave structure further includes the pivoting member disclosed herein.

In some further embodiments, the present invention provides a tent frame including a plurality of supporting poles, a plurality of first connectors, a plurality of second connectors, a hub, a plurality of upper poles, a plurality of oblique poles, two or more sleeve members, and two or more eave poles. Corresponding to each respective supporting pole in the plurality of supporting poles: a first connector in the plurality of first connectors is fixedly coupled with an upper end portion of the respective supporting pole; a second connector in the plurality of the second connectors is slidably coupled with the respective supporting pole and movable along the respective supporting pole below the first connector; an upper pole in the plurality of upper poles includes a first pole and a second pole, each of the first and second poles having a first end portion and a second end portion, where the first end portion of the first pole is pivotally connected with the hub, the second end portion of the first pole is pivotally connected with the first end portion of the second pole, and the second end portion of the second pole is pivotally connected with the first connector; an oblique pole in the plurality of oblique poles has a first end portion pivotally connected with the second pole of the upper pole at a position between the first and second end portions of the second pole of the upper pole, and a second end portion pivotally connected with the second connector. Corresponding to each respective first connector in two or more first connectors in the plurality of first connectors: a sleeve member in the two or more sleeve members is disposed at the respective first connector; an eave pole in the two or more eave poles has a first end portion pivotally connected with the corresponding oblique pole at the position between the first and second end portions of the corresponding oblique pole, and a second end portion slidably coupled with the sleeve member; and an eave structure is collectively formed by the sleeve member and the eave pole, or by the first connector, the sleeve member and the eave pole. When the tent frame is unfolded, the second end portion of each eave pole passes through the corresponding sleeve member and extends outwardly beyond the corresponding upper pole.

In some embodiments, the number of first connectors, the number of eave members, and the number of eave poles are the same, with each first connector having a corresponding sleeve member and a corresponding eave pole.

In some embodiments, each eave structure of the tent frame further includes a link member to pivotally connect the first end portion of the eave pole with the oblique pole. In an embodiment, the link member is of a "Z" or "S" shape, with a first end portion to pivotally connect with the first end portion of the eave pole and a second end portion to pivotally connect with the oblique pole at the position between the first and second end portions of the oblique pole.

In an embodiment, corresponding to each sleeve member in the two or more sleeve members, a pivoting member is disposed at the first connector apart from a side of the sleeve member, and fixed coupled with or integrally formed with the first connector. The second end portion of the second pole of the upper pole is disposed between the pivoting member and the sleeve member, and pivotally connected with one or more of the pivoting member and the sleeve member.

In an alternative embodiment, corresponding to each sleeve member in the two or more sleeve members, a pivoting member is fixedly coupled or integrally formed with the first connector. The pivoting member includes a groove to accommodate the second end portion of the second pole of the upper pole, and the sleeve member is rotatably coupled with a side of the pivoting member.

The eave structures and the tent frames of the present invention have other features and advantages that will be apparent from or are set forth in more detail in the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more embodiments of the present application and, together with the detailed description, serve to explain the principles and implementations of the application.

DETAILED DESCRIPTION

Figure 1:
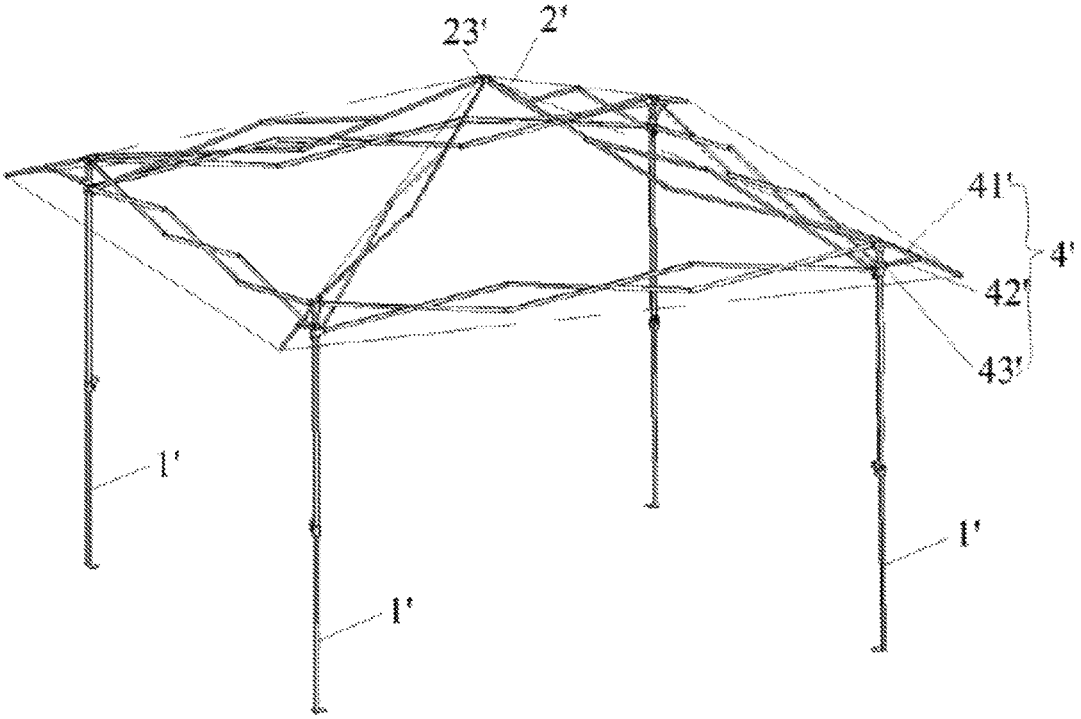
FIG. 1 (Related Art)
FIG. 1 is a schematic view illustrating a tent frame of related art.
Figure 2:
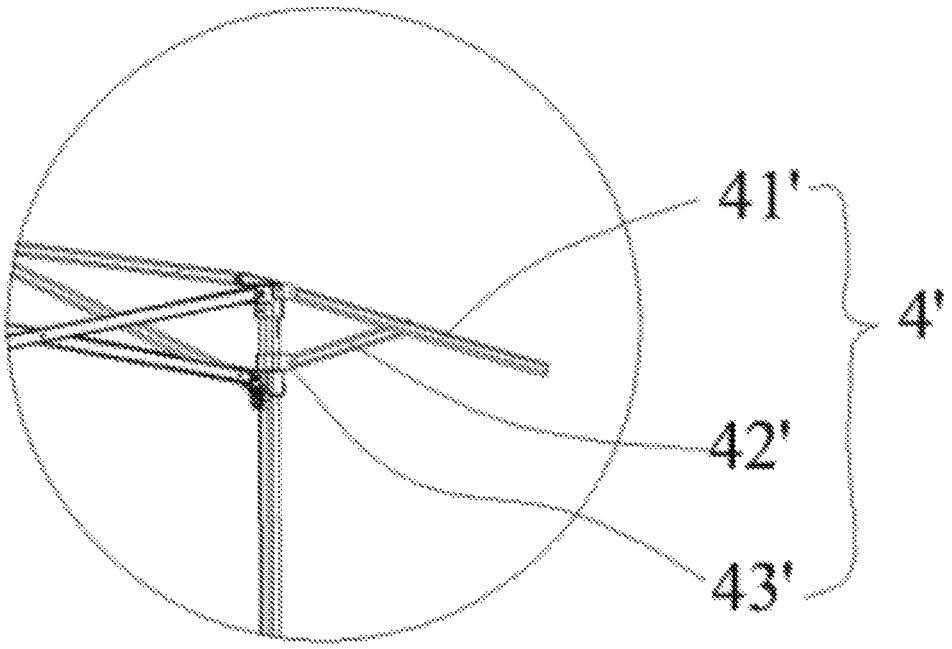
FIG. 2 (Related Art)
FIG. 2 is an enlarged view illustrating an eave structure of FIG. 1.

Reference will now be made in detail to implementations of the exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application—and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the embodiments set forth in this disclosure can be made without departing from their spirit and scope, as will be apparent to those skilled in the art. The specific embodiments described herein are offered by way of example only, and the disclosure is to be limited only by the terms of the appended claims, along with the full scope of equivalents to which such claims are entitled.

Embodiments of the present invention are described in the context of eave structures and tent frames having such eave structures. Generally, a tent frame of the present invention includes a plurality of supporting poles and an upper frame connected with the plurality of supporting poles. It can be of various sizes and shapes, and can include various number of supporting poles such as three, four, five or more supporting poles. A tent frame of the present invention also includes a plurality of eave structures, the number of which can be varied depending on applications, preferences or the like. For instance, it can include two eave structures, three eave structures, or as many as the number of the supporting poles.

An eave structure usually includes an eave pole, and a mechanism connecting the eave pole with the upper frame and one of the supporting poles (the supporting pole or an element disposed at the supporting pole). When the tent frame is unfolded, the eave pole extends beyond the upper frame and/or the supporting pole. Such an eave pole, along with the upper frame, can be used to support a tent cloth such as a canopy. As the eave pole extends beyond the upper frame and/or the supporting pole, it helps to increase the shading area, and/or shed rain or snow away from the sides of the tent.

Figure 3:
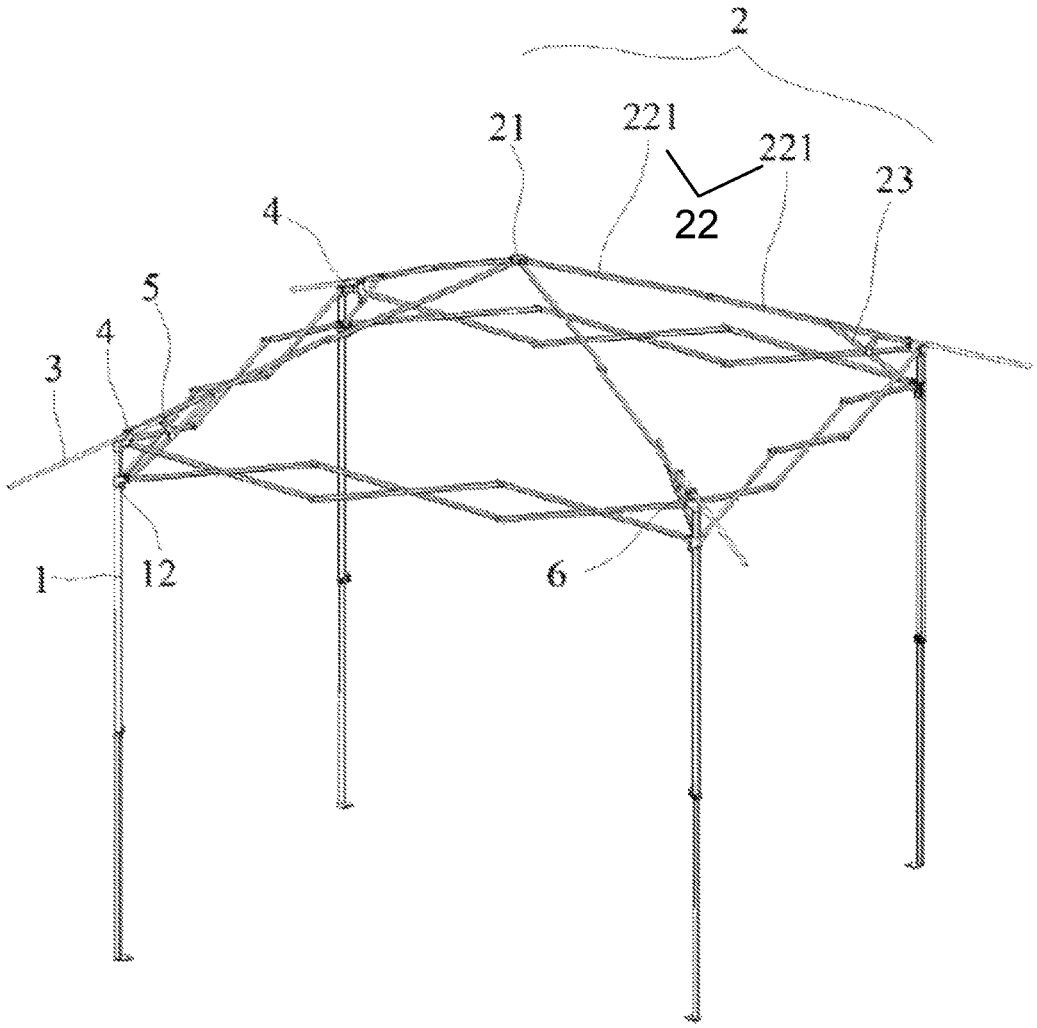
FIG. 3 is a schematic view illustrating a tent frame in an unfolded state in accordance with exemplary embodiments of the present invention.

Referring now to FIG. 3, there is depicted an exemplary tent frame in an unfolded state in accordance with some exemplary embodiments of the present invention. As shown, the tent frame includes a plurality of supporting poles 1, with a plurality of first connectors 11 and a plurality of second connectors 12 disposed on the supporting poles to connect the supporting poles with other elements of the tent frame. In some embodiments, each first connector is fixedly coupled with a supporting pole at an upper end portion (e.g., the top) of the supporting pole. Each second connector is slidably coupled with a supporting pole and is movable along the supporting pole below the first connector.

The tent frame also includes an upper frame such as upper frame 2 coupled with the plurality of supporting poles. Upper frame 2 is disposed above and supported by the plurality of support poles when the tent frame is unfolded. In some embodiments, upper frame 2 includes hub 21, a plurality of upper poles 22 and a plurality of oblique poles 23. Each upper pole has a first end portion pivotally connected the hub, and a second end portion pivotally connected with the first connector at a corresponding supporting pole. In some embodiments, each upper pole includes two or more poles pivotally connected with each other. Among the two or more poles, the pole adjacent the hub (referred herein as the first pole) has an end portion pivotally connected with the hub, and the pole adjacent the corresponding supporting pole (referred herein as the second pole) has an end portion pivotally connected with the first connector at a corresponding supporting pole. The first pole and the second pole are pivotally connected, directly or indirectly, with each other. By way of example, FIG. 3 illustrates each upper pole includes two poles 221, in which the first end portion of first pole 221 (the pole adjacent the hub) is pivotally connected with the hub, the second end portion of the first pole is pivotally connected with the first end portion of second pole 221 (the pole adjacent the supporting pole), and the second end portion of the second pole is pivotally connected with the first connector disposed at the supporting pole.

Each oblique pole 23 is connected with an upper pole and a supporting pole. In some embodiments, each oblique pole has a first end portion pivotally connected with an upper pole and a second end portion pivotally connected with the second connector disposed at a supporting pole. In embodiments where the corresponding upper pole includes two or more poles, the first end portion of the oblique pole is pivotally connected with the second pole of the corresponding upper pole. In an embodiment, the first end portion of the oblique pole is pivotally connected with the second pole of the corresponding upper pole at a position between the first and second end portions of the second pole of the upper pole.

The tent frame further includes two or more eave poles 3, and mechanisms to couple the eave poles with the upper frame and the supporting poles (the supporting poles or elements disposed at the supporting poles). Collectively, an eave pole and a mechanism to couple the eave pole with the upper frame and a supporting pole are referred herein as an eave structure.

Figure 4:
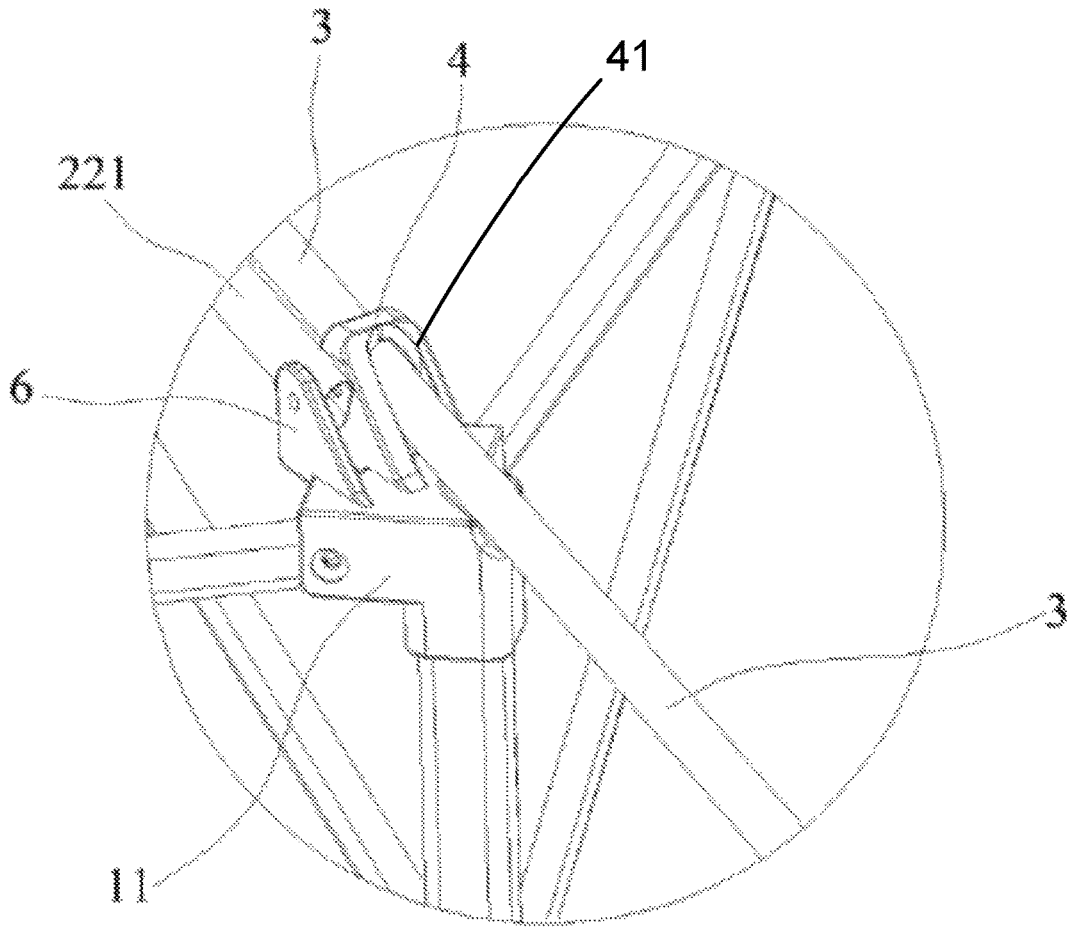
FIG. 4 is a first schematic view illustrating an eave structure of a tent frame in an unfolded state in accordance with exemplary embodiments of the present invention.
Figure 5:
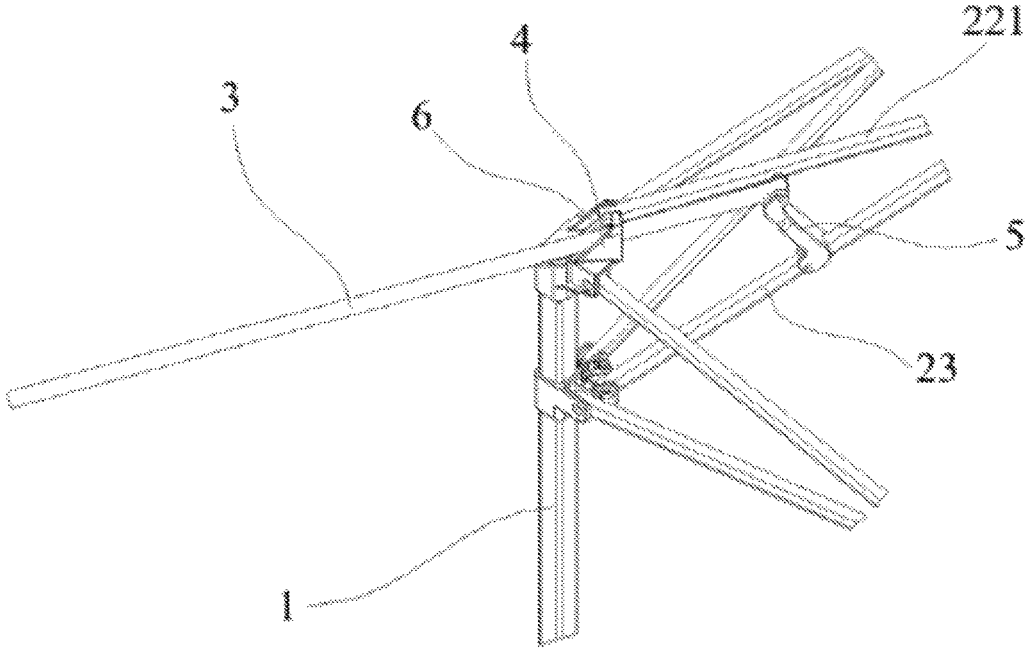
FIG. 5 is a second schematic view illustrating an eave structure of a tent frame in an unfolded state in accordance with exemplary embodiments of the present invention.
Figure 6:
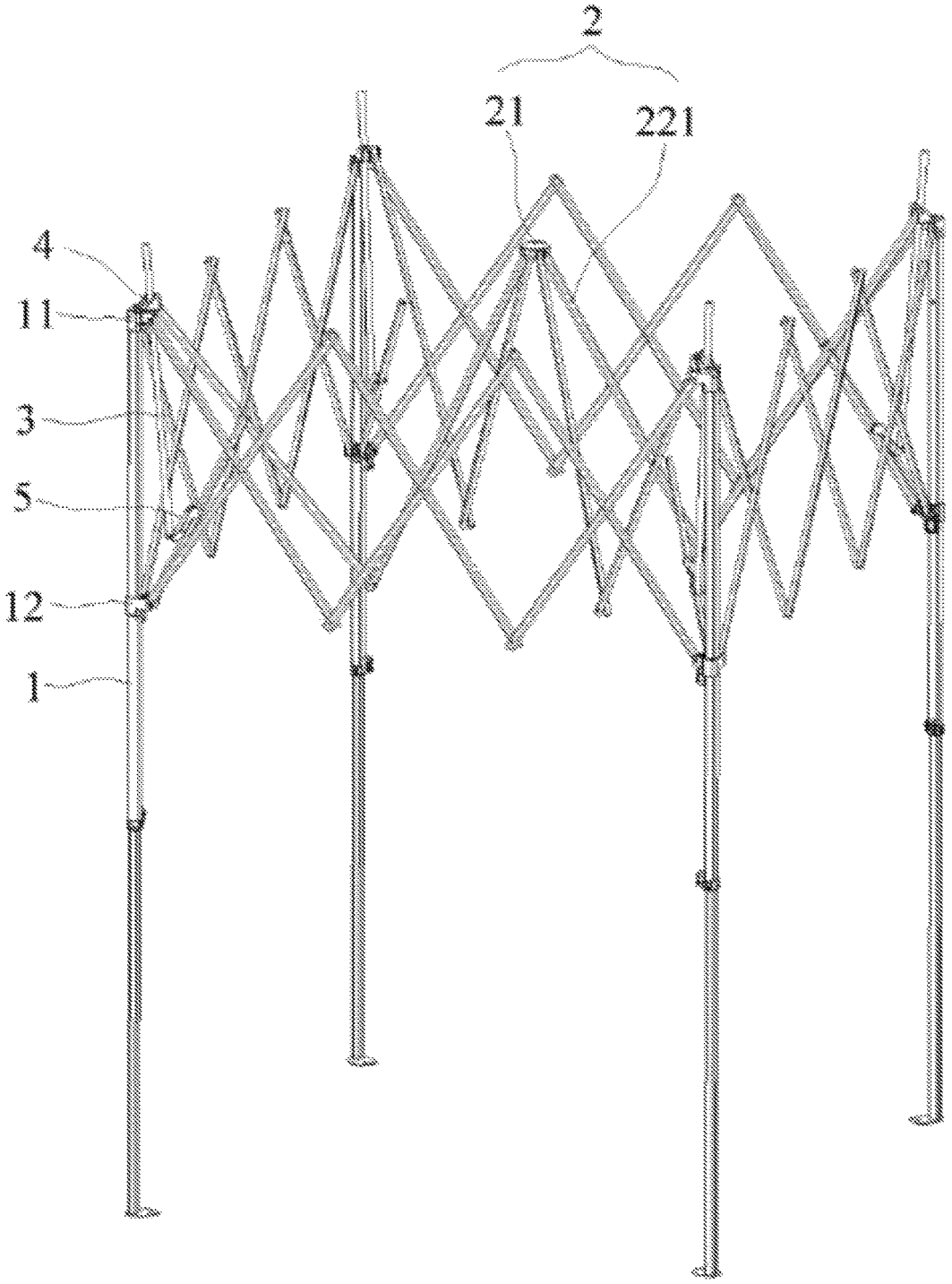
FIG. 6 is a schematic view illustrating the tent frame of FIG. 3 in a semi-folded state in accordance with exemplary embodiments of the present invention.
Figure 7:
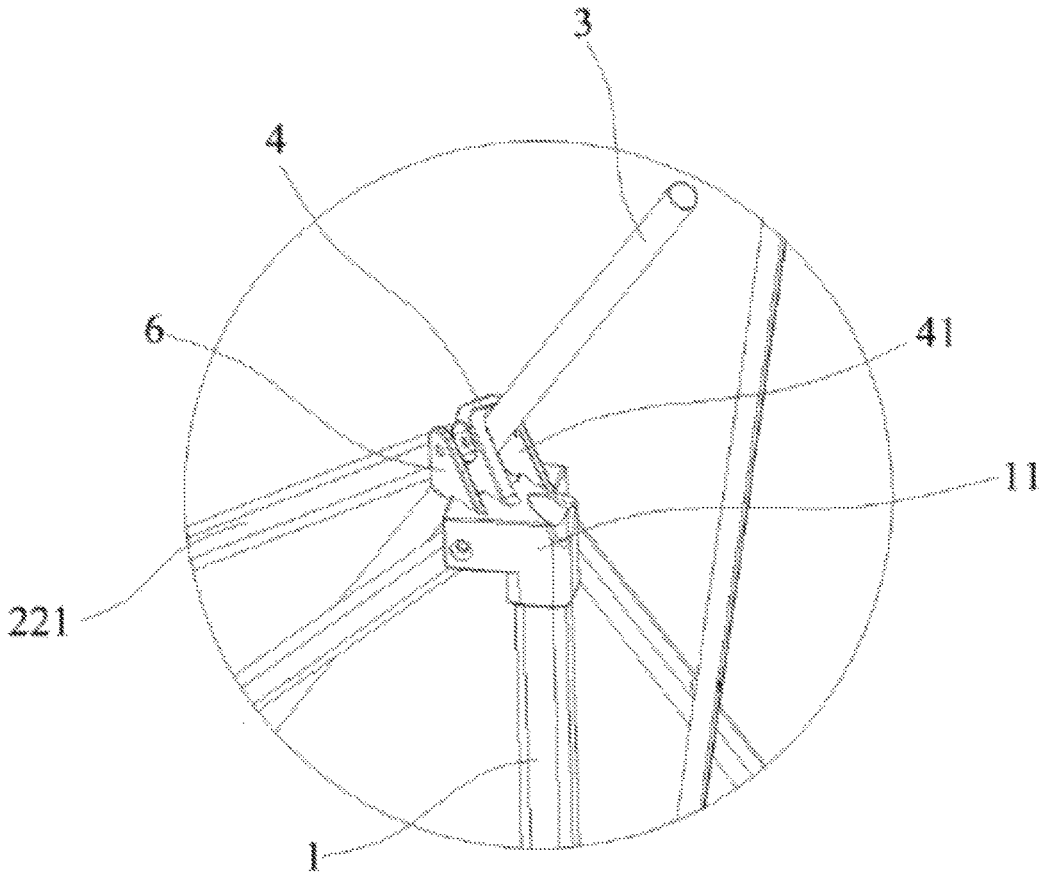
FIG. 7 is a first schematic view illustrating an eave structure of a tent frame in a semi-folded state in accordance with exemplary embodiments of the present invention.
Figure 8:
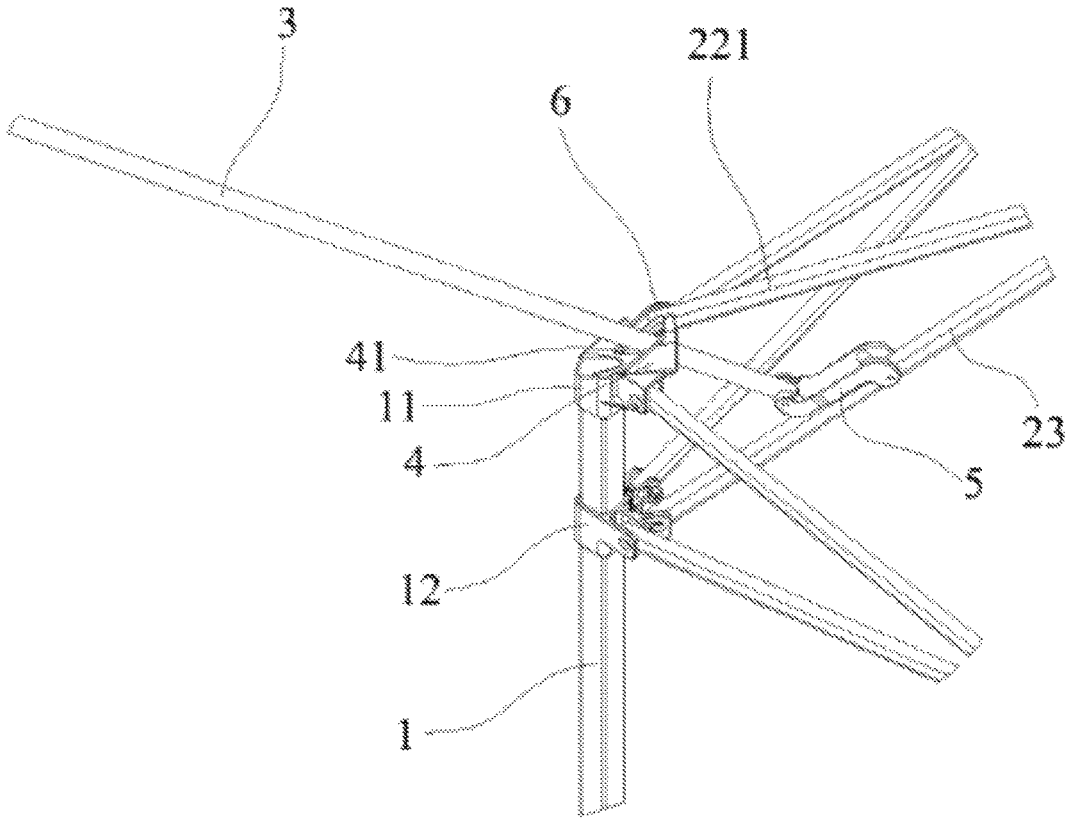
FIG. 8 is a second schematic view illustrating an eave structure of a tent frame in a semi-folded state in accordance with exemplary embodiments of the present invention.

FIGS. 4 and 5 illustrate an eave structure in an unfolded state in accordance with some exemplary embodiments of the present invention. As shown, eave pole 3 has a first end portion pivotally coupled with the upper frame such as oblique pole 23 of the upper frame. In an embodiment, the first end portion of the eave pole is pivotally coupled with the oblique pole at a position between the first and second end portions of the oblique pole. In some embodiments, an eave structure includes a link member such as link member 5 to pivotally connect the first end portion of the eave pole with the oblique pole. Link member 5 can be configured with any suitable shapes such as a "Z" shape, a "S" shape or the like, with its first end portion configured to pivotally connect the first end portion of eave pole 3 and its second end portion to pivotally connect oblique pole 23 at a position between the first and second end portions of the oblique pole.

An eave structure also includes a sleeve member such as sleeve member 4 to couple eave pole 3 with a supporting pole. Sleeve member 4 is disposed at first connector 11, and in some cases, disposed at a top of the first connector and fixedly coupled/formed with the first connector. In some embodiments, sleeve member 4 is formed with through hole 41 for slidably coupling with eave pole 3. When the tent frame is unfolded, through hole 41 of sleeve member 4 allows the second end portion of eave pole 3 to pass through and extend outwardly beyond upper pole 22 and/or beyond supporting pole 1.

In some embodiments, a pivoting member such as pivoting member 6 is disposed at the first connector apart from a side of the sleeve member. Pivoting member 6 is fixedly coupled with or integrally formed with the first connector. In such an embodiment, the second end portion of second pole 221 of the upper pole is disposed between the pivoting member and the sleeve member, and pivotally connected with the pivoting member, the sleeve member, or both of the pivoting member and the sleeve member.

Figure 10:
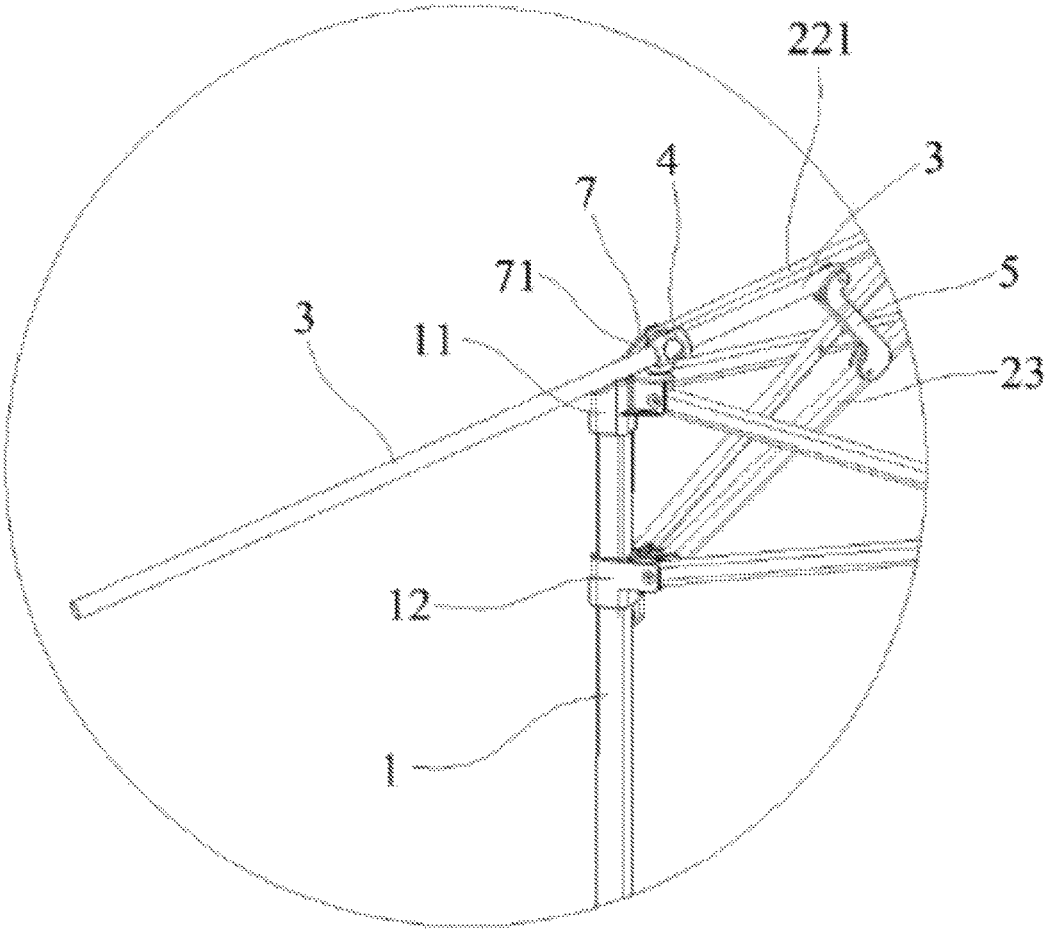
FIG. 10 is a schematic view illustrating an alternative eave structure of a tent frame in in an unfolded state in accordance with exemplary embodiments of the present invention.

Alternatively, in some embodiments such as that illustrated in FIG. 10, a pivoting member such as pivoting member 7 is fixedly coupled or integrally formed with first connector 11. Pivoting member 7 includes groove 71 to accommodate the second end portion of the second pole of the upper pole. In an embodiment, sleeve member 4 is rotatably coupled with a side of pivoting member 7.

In some embodiments, sleeve member 4, link member 5 or both are configured such that when the tent frame is unfolded, the eave pole is sloped substantially the same as the second pole of the upper pole. This can be achieved, for instance, by selecting the position at which the link member is connected with the oblique pole and configuring the link member with a proper length. In an embodiment, once the eave pole is sloped substantially the same as the second pole of the upper pole, an interior upper surface of through hole 41 serves as a stopper to restrain the eave pole from further rotating beyond the unfolded state.

In some embodiments, the first connector is a constituent of the eave structure. In an embodiment, the first connector and the pivoting member disclosed herein are constituents of the eave structure.

It should be noted that a tent frame of the present invention can include a various number of eave structures, depending on the application, preference, or the like. For instance, in an embodiment where only one side of the tent needs shades, the tent frame can include two eave structures, with each eave structure connected with one of two adjacent supporting poles. In an embodiment where two sides of the tent need shades, the tent frame can include three eave structures, with each eave structure connected with one of three adjacent supporting poles. In a further embodiment where all sides of the tent need shades, the tent frame can include the same number of eave structures as the supporting poles, with each eave structure connected with one of the supporting poles.

The eave structure of the present invention can be folded and unfolded along with the other elements of the tent frame. For instance, referring to FIGS. 3-5, when unfolding the tent frame, the first and second poles 221 of upper pole 22 are unfolded to form a substantially straight line. The first end portion of oblique pole 23 moves upwardly with the second pole 221. Via second connector 12, the second end portion of oblique pole 23 moves upwardly along supporting pole 1. Link member 5 moves with the oblique pole, and pushes and/or rotates eave pole 3, such that the second end portion of eave pole 3 passes through sleeve member 4 and extends outwardly.

Figure 9:
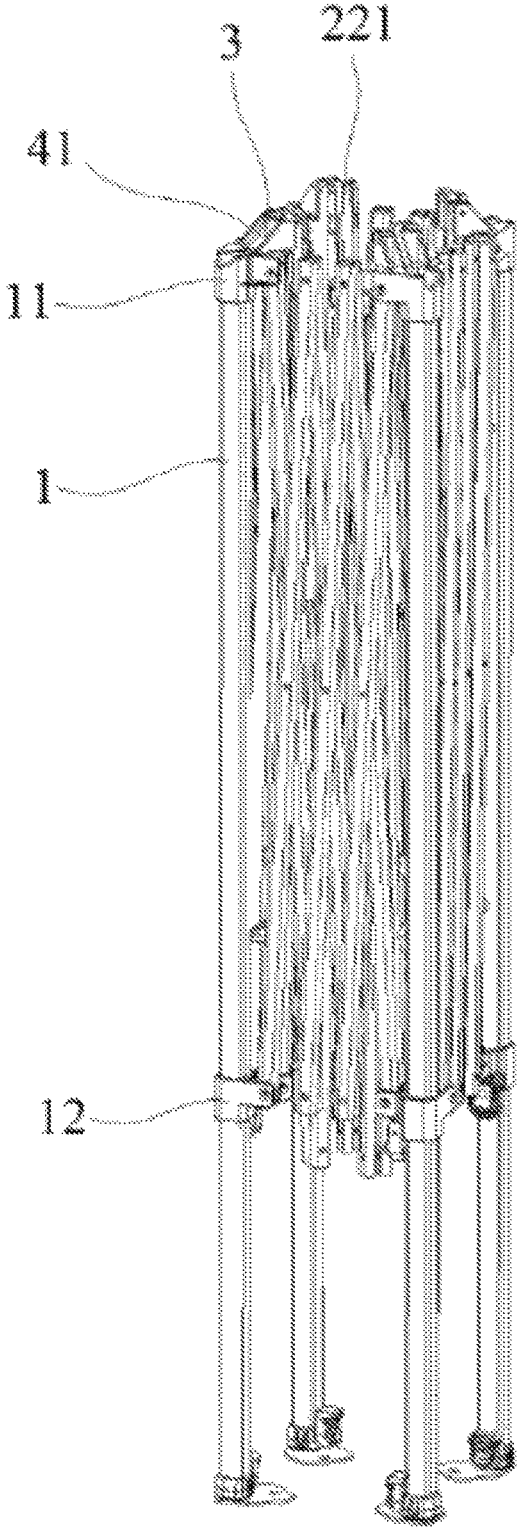
FIG. 9 is a schematic view illustrating the tent frame of FIG. 3 in a folded state in accordance with exemplary embodiments of the present invention.

Referring to FIG. 6-9, when folding the tent frame, second connector 12 slides downwardly along supporting pole 1, pulling oblique pole 23 downwardly. In turn, the oblique pole pulls eave pole 3 downwardly such that the second end portion of eave pole 3 retracts back to the sleeve member. The oblique pole also pulls downwardly first and second poles 221 of the upper pole. The link member 5 folds toward the oblique pole. As illustrated in FIG. 9, the folded tent frame (or tent) is compact with all poles folded towards each other.

As disclosed herein, when the tent frame is unfolded, the second end portion of eave pole 3 extends outwardly beyond the upper pole and the supporting pole. Thus, the eave structure of the present invention can be used to extend a tent cloth such as a canopy beyond the side(s) of the tent. As a result, it can help to provide a larger shading area in sunny days. It also helps to smooth the tent cloth/canopy, and thus helps to shed snow and rain away from the sides of the tent, reducing the risk of water (e.g., rain) and snow accumulation in snowy and raining days. Moreover, the tent frame of the present invention is convenient to use as the eave structure of the present invention can be folded and unfolded along with other elements of the tent frame. Further, the tent frame of the present invention when folded is compact as the eave poles are retracted and folded together with all of the other poles of the tent frame, making it easy to carry and store.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "upper" or "lower", "upwardly" or "downwardly", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first connector could be termed a second connector, and, similarly, a second connector could be termed a first connector, without changing the meaning of the description, so long as all occurrences of the "first connector" are renamed consistently and all occurrences of the "second connector" are renamed consistently.

What is claimed is:

1. An eave structure of a tent frame, wherein the tent frame comprises a supporting pole, a first connector, a second connector, a hub, an upper pole and an oblique pole, the eave structure comprising:

a sleeve member configured to be disposed at the first connector of the tent frame;

a link member of a "Z" or "S" shape, the link member having a first end portion and a second end portion, the second end portion configured to be pivotally connected with the oblique pole at a position between the first and second end portions of the oblique pole; and an eave pole having a first end portion configured to be pivotally connected with the first end portion of the link member, and a second end portion configured to be slidably coupled with the sleeve member, wherein when the tent frame is unfolded, the second end portion of the eave pole passes through the sleeve member and extends outwardly beyond the upper pole, wherein:

the first connector is fixedly coupled with an upper end portion of the supporting pole;

the upper pole comprises a first pole and a second pole, each having a first end portion and a second end portion, wherein the first end portion of the first pole is pivotally connected with the hub of the tent frame, the second end portion of the first pole is pivotally connected with the first end portion of the second pole, and the second end portion of the second pole is pivotally connected with the first connector;

the oblique pole has a first end portion pivotally connected with the second pole of the upper pole at a position between the first and second end portions of the second pole of the upper pole, and a second end portion pivotally connected with the second connector of the tent frame; and the second connector is slidably coupled with the supporting pole and movable along the supporting pole below the first connector.

2. The eave structure of claim 1, wherein one or more of the sleeve member and the link member are configured such that when the tent frame is unfolded, the eave pole is sloped substantially the same as the second pole of the upper pole.

3. The eave structure of claim 1, wherein the sleeve member is formed with a through hole through which the second end portion of the eave pole passes, and when in an unfolded state in which the eave pole is sloped substantially the same as the second pole of the upper pole, an interior upper surface of the through hole serves as a stopper to restrain the eave pole from further rotating beyond the unfolded state.

4. The eave structure of claim 1, wherein the sleeve member is fixedly coupled with or integrally formed with the first connector at a top of the first connector.

5. The eave structure of claim 4, wherein a pivoting member is disposed at the first connector apart from a side of the sleeve member, and fixedly coupled with or integrally formed with the first connector, wherein the second end portion of the second pole of the upper pole is disposed between the pivoting member and the sleeve member, and pivotally connected with one or more of the pivoting member and the sleeve member.

6. The eave structure of claim 1, wherein a pivoting member is fixedly coupled or integrally formed with the first connector, wherein the pivoting member comprises a groove to accommodate the second end portion of the second pole of the upper pole, and the sleeve member is rotatably coupled with a side of the pivoting member.

7. An eave structure of tent frame, wherein the tent frame comprises a supporting pole, an upper pole and an oblique pole, the eave structure comprising:

a first connector configured to be fixedly coupled with an upper end portion of the supporting pole;

a sleeve member disposed at the first connector;

a link member of a "Z" or "S" shape, the link member having a first end portion and a second end portion, the second end portion configured to be pivotally connected with the oblique pole at a position between the first and second end portions of the oblique pole; and an eave pole having a first end portion configured to be pivotally connected with the first end portion of the link member, and a second end portion configured to be slidably coupled with the sleeve member, wherein when the tent frame is unfolded, the second end portion of the eave pole passes through the sleeve member and extends outwardly beyond the upper pole, wherein:

the upper pole comprises a first pole and a second pole, each having a first end portion and a second end portion, wherein the first end portion of the first pole is pivotally connected with a hub of the tent frame, the second end portion of the first pole is pivotally connected with the first end portion of the second pole, and the second end portion of the second pole is pivotally connected with the first connector;

the oblique pole has a first end portion pivotally connected with the second pole of the upper pole at a position between the first and second end portions of the second pole of the upper pole, and a second end portion pivotally connected with a second connector of the tent frame; and the second connector is slidably coupled with the supporting pole and movable along the supporting pole below the first connector.

8. The eave structure of claim 7, wherein one or more of the sleeve member and the link member are configured such that when the tent is unfolded, the eave pole is sloped substantially the same as the second pole of the upper pole.

9. The eave structure of claim 7, wherein the sleeve member is formed with a through hole to allow the eave pole pass through, and when in an unfolded state in which the eave pole is sloped substantially the same as the second pole of the upper pole, an interior upper surface of the through hole serves as a stopper to restrain the eave pole from further rotating beyond the unfolded state.

10. The eave structure of claim 7, wherein the sleeve member is fixedly coupled with or integrally formed with the first connector at a top of the first connector, the eave structure further comprising:

a pivoting member disposed at the first connector apart from a side of the sleeve member, and fixed coupled with or integrally formed with the first connector, wherein the second end portion of the second pole of the upper pole is disposed between the pivoting member and the sleeve member, and pivotally connected with one or more of the pivoting member and the sleeve member.

11. The eave structure of claim 7, further comprising:

a pivoting member fixedly coupled or integrally formed with the first connector, wherein the pivoting member comprises a groove to accommodate the second end portion of the second pole of the upper pole, and the sleeve member is rotatably coupled with a side of the pivoting member.

12. A tent frame comprising:

a plurality of supporting poles;

a plurality of first connectors;

a plurality of second connectors;

a hub;

a plurality of upper poles;

a plurality of oblique poles;

two or more sleeve members;

two or more link members, each having a "Z" or "S" shape; and two or more eave poles, wherein corresponding to each respective supporting pole in the plurality of supporting poles:

a first connector in the plurality of first connectors is fixedly coupled with an upper end portion of the respective supporting pole;

a second connector in the plurality of the second connectors is slidably coupled with the respective supporting pole and movable along the respective supporting pole below the first connector;

an upper pole in the plurality of upper poles comprises a first pole and a second pole, each of the first and second poles having a first end portion and a second end portion, wherein the first end portion of the first pole is pivotally connected with the hub, the second end portion of the first pole is pivotally connected with the first end portion of the second pole, and the second end portion of the second pole is pivotally connected with the first connector; and an oblique pole in the plurality of oblique poles has a first end portion pivotally connected with the second pole of the upper pole at a position between the first and second end portions of the second pole of the upper pole, and a second end portion pivotally connected with the second connector;

wherein corresponding to each respective first connector in two or more first connectors in the plurality of first connectors:

a sleeve member in the two or more sleeve members is disposed at the respective first connector;

a link member in the two or more link members has a first end portion and a second end portion, the second end portion pivotally connected with the corresponding oblique pole at a position between the first and second end portions of the corresponding oblique pole;

an eave pole in the two or more eave poles has a first end portion pivotally connected with the first end portion of the link member, and a second end portion slidably coupled with the sleeve member, wherein when the tent frame is unfolded, the second end portion of the eave pole passes through the sleeve member and extends outwardly beyond the upper pole; and wherein an eave structure is collectively formed by the sleeve member and the eave pole, or by the first connector, the sleeve member and the eave pole.

13. The tent frame of claim 12, wherein the number of first connectors, the number of eave members, and the number of eave poles are the same, wherein each first connector has a corresponding sleeve member and a corresponding eave pole.

14. The tent frame of claim 12, wherein corresponding to each sleeve member in the two or more sleeve members, a pivoting member is disposed at the first connector apart from a side of the sleeve member, and fixed coupled with or integrally formed with the first connector, wherein the second end portion of the second pole of the upper pole is disposed between the pivoting member and the sleeve member, and pivotally connected with one or more of the pivoting member and the sleeve member.

15. The tent frame of claim 12, wherein corresponding to each sleeve member in the two or more sleeve members, a pivoting member is fixedly coupled or integrally formed with the first connector, wherein the pivoting member comprises a groove to accommodate the second end portion of the second pole of the upper pole, and the sleeve member is rotatably coupled with a side of the pivoting member.

* * * * *